United States Patent [19]

Plumadore

[11] 4,249,328

[45] Feb. 10, 1981

[54] ELECTROPHOTOGRAPHIC SLIDE AND METHOD OF MAKING SAME

[75] Inventor: John D. Plumadore, Westfield, Mass.

[73] Assignee: Photon Chroma, Inc., Westfield, Mass.

[21] Appl. No.: 53,901

[22] Filed: Jul. 2, 1979

[51] Int. Cl.[3] ..... A47G 1/06; G09F 1/10

[52] U.S. Cl. ..... 40/158 B; 40/159; 354/3; 355/72; 355/122

[58] Field of Search ..... 354/3; 40/158 B, 158 R, 40/159, 152; 355/72, 122

[56] References Cited

U.S. PATENT DOCUMENTS

| | | | |
|---|---|---|---|
| 3,077,150 | 2/1963 | Schaffert | 354/3 X |
| 3,240,142 | 3/1966 | O'Brien, Jr. | 40/152 X |
| 3,542,465 | 11/1970 | Pundsack | 354/3 X |
| 3,694,069 | 9/1972 | Yamaji et al. | 355/72 X |
| 3,813,164 | 5/1974 | Skowron et al. | 355/122 X |
| 3,864,035 | 4/1975 | Kuehnle | 354/3 X |
| 4,064,514 | 12/1977 | Gundlach | 354/3 |

FOREIGN PATENT DOCUMENTS 2112132 11/1971 Fed. Rep. of Germany ..... 355/72

*Primary Examiner*—John F. Pitrelli
*Assistant Examiner*—G. Lee Skillington
*Attorney, Agent, or Firm*—Chapin, Neal & Dempsey

[57] ABSTRACT

An improved slide for electrophotographic film which comprises a pair of slide frame forming panels hingedly connected along adjacent edges enabling the panels to be folded together in superposed relation. The inner surfaces of each panel is coated with a pressure sensitive adhesive which bonds an electrophotographic film to one panel. A transparent protective film or a second photographic film may be bonded to the other panel. A conductive foil strip is affixed along an edge of the film for providing a grounding contact required for imaging the film in a duplicating camera and a release paper is disposed over the adhesive coating of the other panel. Subsequent to imaging, a slide is formed by stripping off the release paper and folding the panels so that the adhesive coating bonds the inner surfaces together with the film being retained therebetween.

10 Claims, 5 Drawing Figures

Fig. 1.
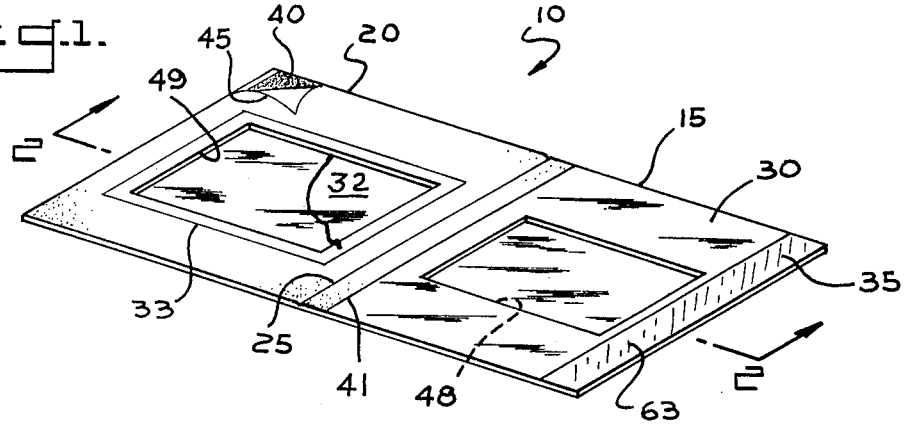
Fig. 2.
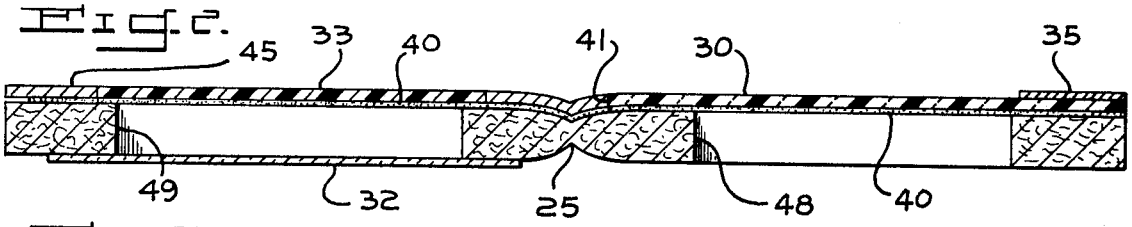
Fig. 3.
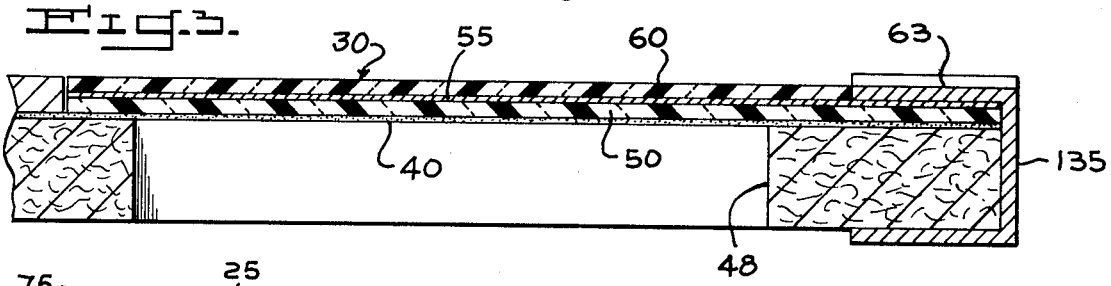
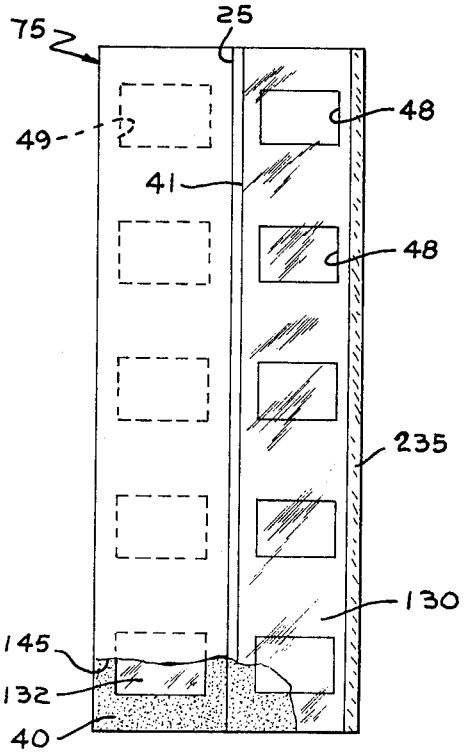
Fig. 4.
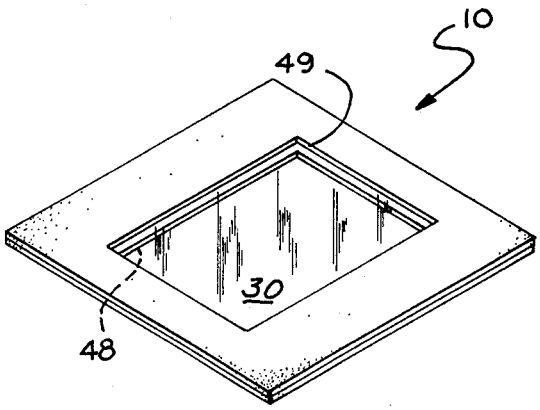
Fig. 5.

ELECTROPHOTOGRAPHIC SLIDE AND METHOD OF MAKING SAME

BACKGROUND

The use of slide transparencies has in recent years become increasingly popular, particularly in the field of visual communications. Those involved in the dissemination of ideas for such purposes as educational courses and business, professional and governmental seminars are continually seeking new ways to present information visually. One of the most convenient and readily available techniques for such presentation involves the use of standard 35 mm slide transparencies. For maximum utilization of such slide transparencies a simple and convenient method must be available for reproducing various printed materials as projectable images on slide transparencies.

While silver halide and diazo film have been used in making such slide transparencies, the imaging and developing processes for such film are generally time consuming and require trained operators. On the other hand, electrophotography while capable of producing excellent high resolution images in a convenient and economical manner, lacks effective methods and means for utilizing electrophotographic film in slide transparencies projectable in 35 mm projectors.

The only commercially available electrophotographic slide processing system employs fully mounted slide frames. These frames consist of a film laminated between two window apertured paperboard frames, the plane of the film being recessed inwardly of the outer surface of the frames. A hole is provided through one of the frames for contact with the photoconductive layer of the film. In the use of these slides some imaging deficiencies have been encountered, particularly along the outer edges of the film adjacent the window edge of the frame. It is believed this difficulty results from the surface tension of the liquid toner which is applied at the toning head of the slide processor system. Inasmuch as the outer surfaces of the frame and film are not coplanar, there is a tendency due to surface tension for the toner to bridge areas of the film adjacent the edges of the frame. Attempts to alleviate this problem have involved the use of paperboard frames sufficiently absorbent to wick up the toner liquid so that the full imaging potential of the film area is utilized. Unfortunately, the frames remain wet or damp as they emerge from the processor unit and tend to warp on drying. As a consequence, it has been the practice to make these frames considerably thicker than the standard 35 mm photographic slide used in the most commercially popular slide projectors, thereby mandating the use of less popular slide projectors or projectors especially adapted for use with these particular slide frames.

Furthermore, this non-coplanar configuration of such prior art slides renders it inconvenient if not impossible to place such slides in surface-to-surface contact with other photographic films such as silver halide or diazo films. Such surface-to-surface contact is desirable for example in the reproduction of an electrophotographic film image onto another type of film or in the superpositioning and simultaneous projection of an electrophotographic film image and a second background image.

It is the principal object of this invention to provide slide transparencies constructed for use in an electrophotographic slide processor which overcome the drawbacks of commercially available slide transparencies.

Another object of this invention is to provide slide transparencies of open frame construction wherein the electrophotographic film provides a wholly planar surface for imaging and toning.

It is a further object of this invention to provide slide transparencies of the above type wherein the planar processing surface is provided with a fully exposed electrically conductive layer.

Yet another object of this invention is to provide a slide transparency frame construction which lends itself to efficient and economical manufacturing procedures, each of use in a slide processor unit and after processing is readily converted to a fully mounted slide frame for projection in standard 35 mm slide projectors.

A further object of the present invention is to provide such a slide transparency which can be assembled without heat sealing.

It is another object of the present invention to provide a slide transparency of the above type wherein the transparency image may be conveniently contact duplicated onto another photographic film such as a diazo or silver halide color film.

It is yet a further object to provide a slide transparency in which images on a pair of film surfaces are disposed in superposed registration with one another for simultaneous projection of a composite image.

BRIEF DESCRIPTION OF THE DRAWINGS

These and other objects will become more readily apparent from the following detailed description taken in connection with the accompanying drawings wherein:

FIG. 1 is a perspective view of an electrophotographic slide frame transparency of open, foldable construction embodying this invention;

FIG. 2 is a sectional view on an enlarged scale taken along line 2—2 of FIG. 1;

FIG. 3 is a partial elevational view of a modified form of the slide transparency of the present invention;

FIG. 4 is a plan view of continuous strip of slide frame transparencies of the type embodying this invention; and FIG. 5 is a perspective view of a fully mounted slide transparency.

DESCRIPTION OF THE PREFERRED EMBODIMENT

Referring to the drawings and particularly to FIGS. 1–3, an electrophotographic film transparency of open, foldable construction is shown generally at 10 and comprises a pair of relatively rigid panels 15 and 20 having window apertures. The panels are foldable along fold or score line 25 to form a slide mount. A strip of electrophotographic film 30 is laminated in edge-to-edge relation on the inner surface of the panel 15. A conductive strip 35 is bonded onto film 30 in contact with the photoconductive layer of the film. The inner surface of panel 20 is coated with a pressure sensitive adhesive 40 (FIG. 2), which is covered by release paper 45 and in the embodiment shown a transparent cover sheet 32 such as acetate or polyester is carried on the outer surface of panel 20 to protect unfixed images on the film 30 when the panels are folded together. The protective film 32 renders unnecessary the fixation of image as by use of a xenon flash. A photographic film transparency 33 may be disposed in the inner surface of panel 20 so that its image side will contact the image side of film 30 when the frame panels are folded together. Film transparency 33 may be any suitable type of film imaged for composite projection with the image on the film 30.

For imaging of the electrophotographic film as described in my copending Application Ser. No. 938,695 for "Electrophotographic Apparatus", filed Aug. 31, 1978, now U.S. Pat. No. 4,202,619 issued May 13, 1980, the photoconductive layer of the film 30 is charged as by a corona, imaged by a light source and then toned as with a toner comprising a liquid carrying suspension of toner particles of carbon black or the like. The toned image may then be "fixed" as with a xenon flash. After imaging a slide transparency mount is formed by removal of the release paper and the folding together of the two panels so that the film is permanently laminated between the frame panels as shown in FIG. 5.

Panels 15 and 20 are formed from a relatively rigid material such as paperboard, synthetic plastic or the like with a fold or hinge line 25 disposed midway between the outer ends of the panels so that when folded together the panels will register in superposed edge-to-edge relation to form a fully mounted slide, preferably of standard (35 mm) size. Each panel includes a window 48 and 49 which are adapted to coincide when the panels are folded together. As best seen in FIG. 1, the dimensions of window 48, such that when the frame members are folded together, the edges of window 48 lie within and parallel to the edges of window 49. This coaxial window arrangement insures full unimpeded projection of images on the film 30, particularly those portions adjacent the edges of the window 48 should the windows become somehow misaligned.

As best shown in FIG. 2, the inner surface of the frame panels is coated with pressure sensitive adhesive 40 which on panel 20 is protected by release strip 45. In the preferred embodiment film 30 is generally coextensive with edges of panel 15 and is laminated onto the inner surface thereof by the adheshive 40. The inner edge of the film is spaced slightly from hinge line 25 so as not to interfere with the folding of the frame panels. The film 30 and release paper meet along a line 41 adjacent hinge 25 on panel 15. The upper surfaces of the film and paper are generally coplanar, thus providing a smooth uniform surface which facilitates handling and imaging of the film in a slide processor system of the type disclosed in my copending application Ser. No. 145,782, filed Apr. 28, 1980.

Conductive strip 35 or other suitable conductive means is disposed along the outer edge of the film 30 opposite hinge line 25. The conductive strip may be any electrically conductive material such as a metallic foil which is bonded by an electrically conductive adhesive onto the film and in contact with the electrically conductive layer of the film 30 shown on an enlarged scale at 55 in FIG. 3. The film illustrated also includes a base layer 50 and photoconducting layer 60. The foil 35 enables grounding during imaging of the layer 55 to the frame of the processing equipment. This is accomplished by scribing the upper surface of strip 35, preferably aluminum foil, sufficiently to cause portions of the foil to penetrate the upper film layer and contact the conductive layer 55. During fabrication of the side frames, the foil is scribed by a mechanism which depresses a plurality of laterally spaced scribe marks 63, as best illustrated in FIGS. 1 and 3. This construction insures grounding of the electrically conductive layer 55 during corona charging of the photoconductive layer 60.

An alternate embodiment of the grounding strip 35 is shown at 135 in FIG. 3. The strip 135 may be a metallic foil which is folded over the outer edge portion frame panel 15 and may be scribed as at 63 for contact with the electrically conductive layer 55 of the film 30 in the same manner as foil 35. This construction while requiring the use of greater quantities of metal foil may be advantageous for firmly bonding the grounding strip to the edge of the slide frame.

Film 33 as discussed above may be an imaged photographic film such as a diazo, silver halide or a second strip of electrophotographic film such that when panels 15 and 20 are folded together, films 30 and 33 are disposed in surface-to-surface contact with one another for composite projection. Film 33 may be a diazo color film and after development remain as part of the transparency as a background image simultaneously projectable with the image on the photoconductive film.

The structural characteristics of slides embodying this invention are such that the slides may be fabricated by mass production techniques. As illustrated in FIG. 4, a continuous strip or web 75 of fiberboard material is coated with a suitable pressure sensitive adhesive 40 which in turn is covered with a suitable release paper. The transparency frame is then punched and creased to form a plurality of spaced windows 48 and 49 on opposite sides of fold line 25. The release paper overlying the strip in which windows 48 have been cut is then removed and a strip of electrophotographic film is mounted on the exposed pressure sensitive adhesive. In the preferred embodiment, film strip 130 to which conductive strip 235 has been previously bonded is then mounted onto the card stock. The conductive foil strip is bonded onto the edge of the film strip using an electrically conductive adhesive and by a scribing technique the foil is made to penetrate the film and contact the conductive layer.

The inner edges of the film strip 130 and the release strip 145 abut along line 41 spaced from hinge line 25 toward windows 48. The outer surface of the strip 75 may be laminated with a transparent protective strip 132. Strip 132 is only applied on side frames fabricated for use in a slide processor in which the image will remain "unfixed", thus being subject to smudging or eradication with careless handling. For slides adapted to be used in slide processing equipment having a xenon light for fixing the image, the protective transparent sheet would be eliminated.

Various alternate configurations will, from the present disclosure, suggest themselves to those skilled in the art. For example, the card stock may be coated with adhesive on both sides thereof for the bonding of protective film 132 and conductive member 135 to the frame panels. Furthermore, the release paper disposed over that portion of the card stock containing windows 49 may be unpunched so as to protect film 132 during processing of the transparency. For enhanced grounding capability the release paper may be provided with a conductive portion adapted to connect with conductive means 235.

Individual slide frames 10 are provided by simply cutting the completed multi-ply unitary strip of FIG. 4 into separate lengths whereby open slide frames, as shown in FIG. 1, are produced. Alternatively, should the mass processing of a multiplicity of slides be required, a multiplicity of such slides may be processed in roll form prior to the separation of the individual slides 10 from one another.

In using the slide frames of the type shown in FIG. 1, the slide may be simply inserted in its open condition film side down in a slide processing apparatus of the type disclosed in my aforesaid copending application Ser No. 145,782. The film is charged by the corona charging head as it enters the unit and is then imaged by exposure to an imaging light source within the unit. After imaging, the film is toned as the slide is retracted from the unit and may be permanently fixed by exposure to a xenon light source. On withdrawal from the apparatus, release paper 45 is simply peeled off the inner surface of the frame panel 20 and the two panels are folded together and adhesively bonded by the adhesive 40. This forms a completed fully mounted slide, as shown in FIG. 5, which is ready for projection in a 35 mm projector.

Another film such as a diazo or silver halide film may be similarly mounted on the same type of slide frame and used for duplicating the image from the electrophotographic film. For this purpose, the slide mounted electrophotographic film is used as a master which can be duplicated on another film also mounted on a foldable slide frame. The frames provide a registration system for holding the two films in surface-to-surface contact. After imaging the second slide may be folded and projected in any conventional manner.

Having thus described my invention, what is claimed is:

1. Slide transparency for electrophotographic film which includes an electrically conductive layer comprising a generally planar frame including a pair of panels defined by a hinge therebetween and each lying in generally in the same plane before folding and each having a window shaped projection aperture therethrough registrable when the panels are folded together about said hinge, the first of said panels having an electrophotographic film disposed thereon spanning the window aperture therein, the inner surface of the second panel having an adhesive thereon for bonding the two panels together in superposed relation when folded about said hinge, and an electrically conductive strip disposed on said film for grounding said electrically conductive layer of the film when imaging said film before said frame is folded.

2. Slide transparency for electrophotographic film as set forth in claim 1 wherein said film is disposed on the inner surface of said first panel and said adhesive is a pressure sensitive adhesive disposed on the second panel, a release material removably covering said adhesive and peelable therefrom for binding the two panels together.

3. Slide transparency for electrophotographic film as set forth in claim 2 in which said electrically conductive material is a metallic foil disposed on the surface of said electrophotographic film.

4. Slide transparency for electrophotographic film as set forth in claim 3 wherein said foil is scribed to cause portions thereof to be deformed into electrical contact with said electrically conductive layer.

5. Slide transparency for electrophotographic film as set forth in claim 3 wherein said release material and film are generally coplanar.

6. Slide transparency for an electrophotographic film as set forth in claim 5 wherein said film is generally coextensive with said first frame panel and terminates in contiguous relation with said release material along a line on said first panel spaced from said hinge whereby the release material spans the hinge area of said slide transparency.

7. Slide transparency for an electrophotographic film as set forth in claim 5 wherein the opening in said second panel is covered with a transparent material for protecting an unfixed image on said electrophotographic film when said frame panels are folded and bonded together.

8. Slide transparency for electrophotographic film as set forth in claim 5 wherein the dimensions of the apertures in said second panel are greater than the corresponding dimensions of the apertures of the first panel so that light transmitted through said second panel will project over the entire image imprinted on said film despite some misalignment of the two panels when bonded together.

9. Slide transparency for electrophotographic film as set forth in claim 1 and further including a photographic film disposed on the second of said panels, spanning the window therein, such that said photographic film and said electrophotograhic film are disposed in surface-to-surface aligned contact when said two panels are bonded together.

10. Slide transparency for electrophotographic film as set forth in claim 9 wherein said photographic film is a pre-imaged color transparency projectable with said electrophotographic film to produce a composite color image.

* * * * *